United States Patent [19]

Cooper

[11] Patent Number: 4,795,959

[45] Date of Patent: Jan. 3, 1989

[54] HARMONIC INDUCTOR FOR GENERATION OF AN ENERGY CONSERVING POWER WAVE

[75] Inventor: Edward Cooper, San Diego, Calif.

[73] Assignee: Lesco Development

[21] Appl. No.: 120,196

[22] Filed: Nov. 4, 1987

Related U.S. Application Data

[63] Continuation of Ser. No. 725,383, Apr. 22, 1985, abandoned.

[51] Int. Cl.[4] ..... G05F 3/06

[52] U.S. Cl. ..... 323/308; 323/331; 363/39; 307/3; 336/165

[58] Field of Search ..... 323/250, 331, 308–310, 323/362; 363/157, 170–173, 39, 44; 328/16, 23; 307/3, 73; 336/155, 160, 165, 178, 212, 234

[56] References Cited

U.S. PATENT DOCUMENTS

| | | | |
|---|---|---|---|
| 1,712,046 | 5/1929 | Meissner | 363/157 |
| 3,038,135 | 6/1962 | Feinberg | 336/165 |
| 3,111,637 | 11/1963 | Ouletta | 336/165 |
| 3,278,829 | 10/1966 | Tillinger | 363/173 |
| 4,206,434 | 6/1980 | Hase | 323/331 X |

FOREIGN PATENT DOCUMENTS

| | | | |
|---|---|---|---|
| 2600765 | 7/1977 | Fed. Rep. of Germany | 323/362 |

*Primary Examiner*—Peter S. Wong

*Attorney, Agent, or Firm*—Brown, Martin, Haller & Meador

[57] ABSTRACT

An energy convertor for generating a power output waveform that contains a fundamental sine wave and a controlled amount of the third harmonic wave to eliminate the sinusoidal peaks and to provide a desired flat top at reduced amplitude. The synchronized generation of the third harmonic is achieved in combination with a new inductor that enhances the harmonic in the magnetic path around the inductor.

13 Claims, 3 Drawing Sheets

HARMONIC INDUCTOR FOR GENERATION OF AN ENERGY CONSERVING POWER WAVE

This is a continuation of application Ser. No. 725,383 filed Apr. 22, 1985, now abandoned.

BACKGROUND OF THE INVENTION

The ever increasing sophistication and logic speed of computers have made these devices extremely sensitive to power-line disturbances. Line-voltage spikes and noise cause not only physical damage, but also frequent loss of data and irreplaceable information. Numerous attempts have been made to develop various types of protectors to prevent damaging electrical noise from interfering with the computer operation Such devices are generally known as Line Conditioners or Filters. These devices may be grouped into two categories of active and passive circuits.

The passive circuits are essentially filter networks, which may include some form of surge protector and which have no components to alter the basic shape of the incoming line-voltage sine wave. On the other hand, the line conditioners with active circuits include some form of voltage regulator that can maintain the output voltage within reasonable limits under extreme high or low line-input conditions. The active circuits in the line conditioners range from ferro-resonant devices to many types of tap-switching, multi-primary switching, switch-mode synthesizers and energy dispensers. All of these devices are well-known in the art. However, all of these devices utilize circuits to either maintain or to restore an almost perfect sine wave, and their quality is not only judged by their regulation response time, noise rejection, and efficiency, but also by the quality of the output sine wave, i.e., minimum distortion and harmonic content.

The general assumption is that most electrical equipment was designed to operate on the line-voltage sine wave, and that only a sine wave can provide dependable operation. This assumption, however, can be incorrect; and when it is, this causes a great deal of energy to be wasted in electronic equipment in the form of heat, which also causes great electrical stresses on components so that their life is shortened.

The conventional approach in electronic equipment design is to provide a reliable operating margin that is based on certain standards of utility companies, with some additional margin to allow for power losses that occur in wiring inside the buildings. The typical input voltage design parameters are +/−10% from some average level. In the United States, it is common to use 115 V as average, although the U.S. nominal voltage is actually 120 V. However, the U.S. standard is 120 V +6%/−14%, and this yields an average of 115 V.

In all electronic equipment, especially computers, virtually all of the AC-input power is converted into DC by power supplies. Regardless of configuration, with or without power transformers, all power supplies utilize peak rectifiers that conduct current only during the very peak portion of the input sine wave in order to charge energy into the storage capacitors ad to recharge those capacitors repetitively during every half cycle peak. As soon as the sine wave has passed beyond each peak, the rectifier diodes become reverse-biased and do not conduct again until the sine wave approaches the peak of the next following halfcycle. During the time interval between the sine-wave peaks, the power supplies draw DC energy out of the storage capacitors so that the DC-voltage across these storage capacitors decreases gradually during the discharge time intervals. The DC-voltage waveform across storage capacitors has a characteristic waveform of charge and discharge periods, called "ripple ".

The DC-power supplies in electronic equipment are designed so that their regulator circuits still have sufficient operating margin (compliance voltage) at the very end of each discharge period under the absolute worst case conditions. The worst case condition is when the input line-voltage happens to be very low, 103 V in the United States. Thus, since the rectifiers operate only during the peak of the sine wave, the actual design criteria is not 103 V rms, but its equivalent peak voltage of 145.6 V pk ($103 \times 1.414 = 145.6$).

When the input line-voltage is above this low limit, it causes the DC-voltage on the storage capacitors to increase with a resultant increase in compliance voltage in the DC power supplies. If the power supplies have conventional linear pass regulators, this causes the excess voltage to be absorbed by the regulators, and this excess power is converted (wasted) into heat. The worst case energy waste occurs when the line-voltage is at the extreme high condition of 127 V rms, i.e., 179.5 V peak. This is an increase of 33.9 V of the peak level above the minimum required 145.6 V , amounting to a waste of energy of 23.3%.

One might now conclude that since electronic equipment uses peak rectifiers, it would be advantageous to supply a square wave as a power input. A square wave would achieve essentially continuous conduction of the rectifiers because there is a flat top from start to finish of each half cycle. This would eliminate the ripple voltage, reduce the power supply compliance stress, and greatly improve the system's efficiency. Unfortunately, as shown earlier, the minimum peak voltage (flat top) would have to be about 140 V in order to provide adequate compliance voltage for proper power supply operation. Since there would be no charge/discharge ripple, the square-wave peak can be somewhat lower than the sinusoidal peak of 145.6 V. However the rms value of a square wave is equal to its peak value, i e., a square wave of 140 V peak is also 140 V rms.

Since the electrical equipment was not designed to operate on 140 V rms, all magnetic components (such as transformers, relays, and fans) would saturate and cause malfunction and damage. In addition, the fast-rising wave fronts of a square wave can cause high-frequency noise problems, which is objectionable. The calculations and conclusions of the preceding paragraphs represent the technology and common knowledge of prior art as it is taught today.

SUMMARY OF THE INVENTION

It will now be shown that there is an ideal waveform for electronic equipment that approaches the advantages of a square wave, eliminates the stresses and consequential energy waste of the sine-wave peaks, does not generate the noise problems of fast-rising wave fronts, and still satisfies the basic rms voltage requirements of the nomial line-input voltages. This wave (See FIG. 8) consists of a fundamental sine wave (60 Hz in the United States), which has superimposed on it a controlled amount of in-phase third harmonic wave. The resultant wave has the appearance of a sine wave with a flat top from approximately 55° to 125° and from 235° to 305° of the fundamental wave.

In FIG. 9 there is illustrated a detailed relationship of a fundamental sine wave, Line 201; its third harmonic, Line 203; and the resultant combined wave, dotted Line 205. Wave 205 results from the fundamental and third harmonic being added to each other. The amplitude ratio of the third harmonic to the fundamental can be optimized so that the combined wave (algebraic sum) has a flat top, which has a flatness error of less than 1% from 55° to 125°, and from 235° to 305° of the fundamental wave.

A methematical analysis shows that a third harmonic content of 13.8% yields a flatness of +/−0.5% from 55° to 125° of each 180° half-cycle, and a 1% flatness is held by third harmonic contents from 13% to 14.5%. Thus, the ultimate choice is not excessively critical.

There is an inherent symmetry in the overall waveform of FIG. 9, thus a mathematical analysis from 0° to 90° of the fundamental wave satisfies all four quandrants. Table I shows the sine values of the fundamental in 5-degree increments from 55° to 90°, and the corresponding sine values of the third harmonic in 15° increments.

TABLE I

| | | | | | | | | |
|---|---|---|---|---|---|---|---|---|
| Fundamental Sine | 55° | 60° | 65° | 70° | 75° | 80° | 85° | 90° |
| Equal to | .8192 | .8660 | .9063 | .9397 | .9659 | .9848 | .9962 | 1.0000 |
| 3rd Harmonic | 165° | 180° | 195° | 210° | 225° | 240° | 255° | 270° |
| Equal to | 15° | 0° | −15° | −30° | −45° | −60° | −75° | −90° |
| Sine Equal to | +.2588 | .0000 | −.2588 | −.5000 | −.7071 | −.8660 | −.9659 | −1.0000 |

Table II shows the algebraic sum of the fundamental size and relative amplitude of the 13.8% third harmonic.

TABLE II

| | 55° | 60° | 65° | 70° | 75° | 80° | 85° | 90° |
|---|---|---|---|---|---|---|---|---|
| Fundamental | .8192 | .8660 | .9063 | .9397 | .9659 | .9848 | .9962 | 1.000 |
| Third Harmonic | .0375 | .0000 | −.0357 | −.0690 | −.0976 | −.1195 | −.1333 | −.138 |
| SUM = | .8549 | .8660 | .8706 | .8707 | .8683 | .8653 | .8629 | .8620 |

The highest value is at 70°=0.8707, and the lowest value is at 55°=0.8549.

The total difference is 1.0158 =0.8628 +/−0.004=+/−0.46%.

If the fundamental is chosen to be of such value that by adding 13.8% third harmonic, the flat top peak becomes equal to the peak value of a low-line voltage sine wave, i.e., 145.6 V , it yields the following relationship:

| | |
|---|---|
| Fundamental - 13.8% = | 145.6 V pk |
| Fundamental = | 168.9 V pk |
| = | 119.4 V rms |
| Third Harmonic = | 13.8% of 119.4 V rms |
| = | 16.48 V rms |

Thus, the fundamental must be 119.4 V rms, and the third harmonics 16.48 V rms. As seen above, the algebraic sum of those two values produces an almost perfact flat top waveform.

The net rms value of the combined wave is the rms sum of the two individual voltages:

$$E_{rms} = \sqrt{E_1^2 + E_2^2} = \sqrt{119.4^2 + 16.48^2} = \sqrt{14{,}256 + 271.6} = 120.53\ Vrms$$

The newly generated waveform has such a unique relationship of peak-to-rms values that it can provide the very nominal rms voltage of the utility power while it reduces the peak value to such a low leval that the power supplies in electronic equipment will operate at maximum possible efficiency, and without any voltage stress. Even though it does require a certain amount of power to generate this new waveform, it will reduce the power consumption in the electronic equipment by such a significant amount that the overall net input power used is substantially reduced, and electrical energy is conserved. It should also be noted that the peak value of this wave can still be further reduced because the rectifier conduction period has been increased to about 70°, which reduces the valley in the ripple voltage and, thus, increases the compliance margin.

The energy convertor of this invention provides an output waveform as previously described, which convertor uses in the specific embodiment an inductor in combination with a tank circuit that enhances the third harmonic in the magnetic path around the inductor that provides the combination new and improved output waveform. The circuit includes in the tank circuit an inductor that is capable of providing a combined third harmonic and fundamental wave to provide the desired output wave.

It is therefore an object of this invention to provide a new and improved circuit for the generation of an energy conserving AC-power waveform Other objects and many advantages of this invention will be become more apparent on a reading of the following detailed description and an examination of the drawings, wherein like reference numerals designate like parts throughout and in which:

DETAILED DESCRIPTION OF THE INVENTION

Figure 1:
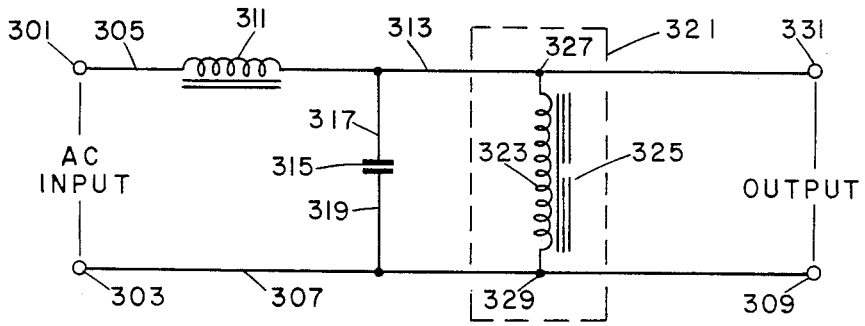
FIG. 1 is a schematic diagram of a circuit embodiment of the invention

With reference to FIG. 1, AC-input power connects to the input port, terminals 301 and 303. The input power may ba a conventional power-line sine wave, or a square wave of the same frequency that is generated by some battery-driven convertor. Terminal 303 connects to line 307, which represents a circuit common reference line, perhaps the neutral of the power line, and which connects ultimately through to the output terminal 309 at the output port. The input terminal 301 connects the AC-input power via line 305 to a conventional inductor 311. The other end of inductor 311 connects via line 313 to the second output terminal 331. A capacitor 315 connects between the output lines 313 and 307 via lines 317 and 319. Also connected between the two output lines at points 327 and 329 is the circuit encompassed harmonic-enhancing inductor 321. The inductor 321 including a coil 323 that is stacked with the magnetic laminations of the type and scope of FIGS. 2–5, which are diagrammatically indicated by the symbolic set of lines 325.

Figure 2:
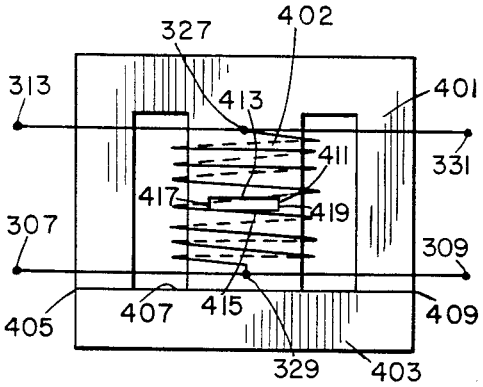
FIG. 2 is a diagrammatic illustration of the shape of a magnetic lamination for the use in the inductor of this invention, which may be used in combination with the waveform convertor of FIGS. 1, 6, and 7.

With reference to FIG. 2, the lamination consists of pairs of thin mating parts, an "E" 401 and an "I" 403. The general dimensional outline of the "E" and the "I" does not have to, but may, conform to conventional transformer laminations and determines only the useful power rating of the device. At the matings points 405, 407, and 409, where the three legs of the "E" 401 butt against the edge of the "I" 403, there are no gaps. Consequently, conventional transformer manufacturing techniques of butt-joint or interleaved stacking may be employed to stack a multitude of these laminations to any desired height or thickness to fill the center hole of a mating coil.

Located at the geometric centerline of the mated E/I pair is a rectangular window 411 cut out that is shaped so that the upper line 413 and lower line 415 form a mechanical and magnetic gap. The left side 417 and right side 419 determine the width of the gap and, thus, establish a ratio between gap width and cross-sectional area of the magnetic path. It will be evident to one skilled in the art that the basic shape of the magnetic lamination does not have to be the E/I configuration in order to construct a symmetric partial gap. For example, any combination of modified "F" shapes or double "E" with symmetrical or nonsymmetrical legs can provide the same properties.

Figure 3:
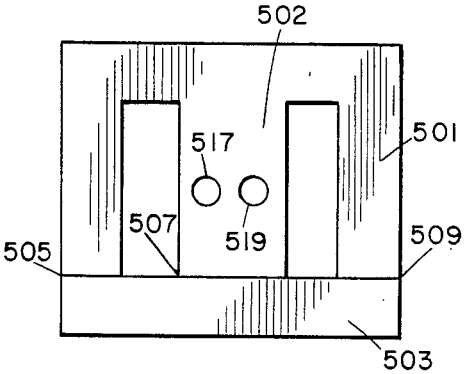
FIGS. 3 through 5 are diagrammatic illustrations of variations in the structure and operation of the magnetic lamination illustrated in FIG. 2.

FIG. 3 illustrates a similar E/I lamination where the single window 411 of FIG. 2 is replaced with two windows 517 and 519 that have a different but related configuration. The net sum of the effective widths of the two circula openings establishes the ratio between the gap width and cross-sectional area of the center leg 502, similar to the single window 411 in center leg 402 of FIG. 2. The members 501 and 503 abut at 505, 507, and 509 in the manner previously described in FIG. 2.

The centered openings, not being squared or rectangular in shape, have to be shaped and sized to provide the desired third harmonic. However, it is preferred that the openings be squared or rectangular.

Figure 4:
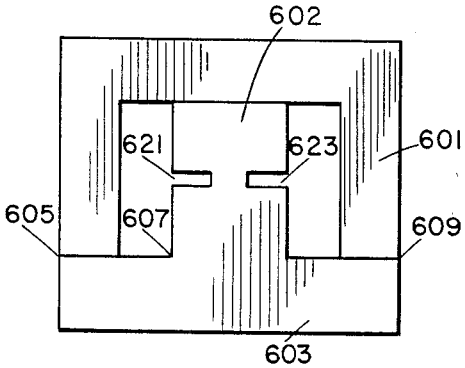

FIG. 4 illustrates yet another mechanical configuration of lamination shape 601 where two rectangular cutouts, 621 and 623, are located on the geometric centerline at the two edges of the center leg 602 of the "T" laminate portion 603. As in FIG. 3, the sum of the two cutout openings establish the ratio between gap width and cross-sectional area of center leg 602. Members 701 and 703 abut at 705 and 709.

With an understanding of the partial magnetic gap in a single coil, it will be understood that there are several mechanical arrangements possible that will yield this property. However, in the preferred embodiment, the mating and abutting magnetic lamination pairs are used that have one or several symmetrical openings on the geometric center of the center leg, the geometric center being a line that is perpendicular to the center line of the coil and parallel to the surface of the magnetic laminations.

Figure 5:
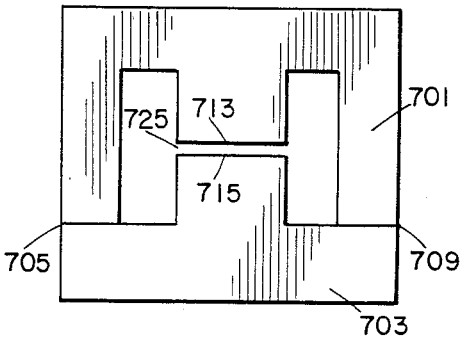
Figure 10:
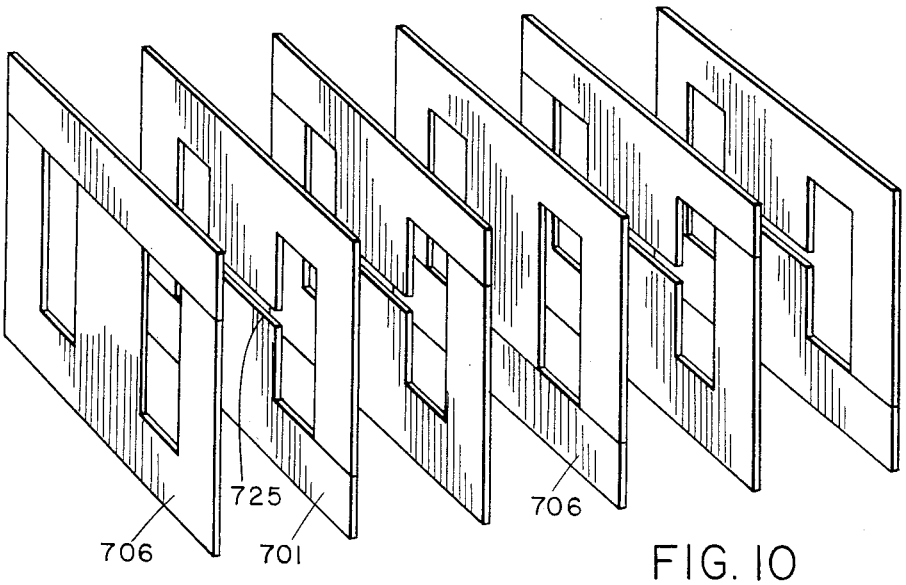
FIG. 10 shows the combined lamination configurations in using the lamination of FIG. 5 in the inductor.
Figure 8:
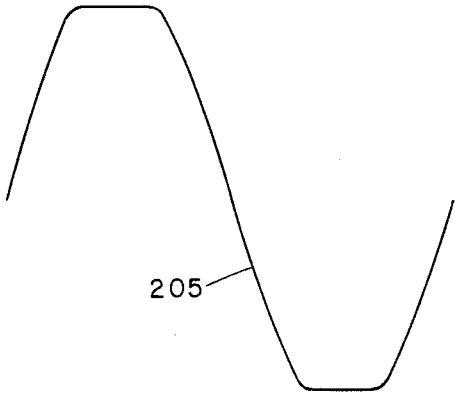
FIG. 8 is an illustration of the desired waveform achieved by the circuit and inductors described herein.
Figure 9:
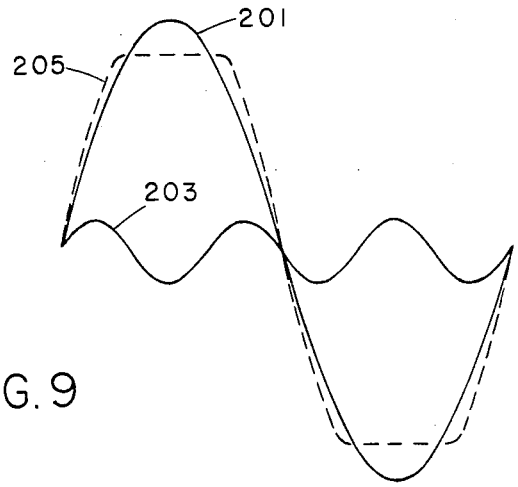
FIG. 9 is an illustration of a sine wave waveform with the third harmonic combined with the fundamental to provide the combined modified waveform.

FIGS. 5 and 10 illustrates another combined lamination shape 701 and 706 that has a complete gap 725 in laminate 701 on its geometric centerline. The basic shape is an E/T with laminate members 701 and 703 abutting at 705 and 709, which is chosen here only to emphasize the several shapes that will yield the same characteristics. This lamination shape 701 with its full-width gap may be used in combination with a quantity of standard no-gap transformer lamination 706 in order to establish a desired ratio of net gap to cross-sectional area. To achieve the third harmonic by having a two-third gap in the center leg of the group lamination configuration, the individual laminations are arranged as illustrated in FIG. 10 with there being two laminations 701 with gaps for each lamination 706 without gaps.

Referring now to the circuit in FIG. 1, the input power drives alternating current into the input port, lines 301 and 303. The input choke 311 acts as a current limiting buffer impedance that permits the output wave at output port, lines 309 and 331, to have a wave shape that is different from the input waveform. Capacitor 315 in parallel with the harmonic-enhancing inductor 321 forms a tank network that rings or oscillates simultaneously at two frequencies—the fundamental frequency of the input power and its third harmonic frequency. The ringing at the third harmonic occurs due to the unique characteristic of the magnetic path around coil 323. With the ratio of gap width to cross-sectional area, the capacitor value, the number of coil turns, and the cross-sectional area and gap height properly chosen, the tank circuit enhances the third harmonic wave and rings with a predictable amplitude.

In a no-gap inductor, the magnetic flux density is a function of cross-sectional area, applied voltage, number of turns, and frequency of the applied AC-voltage. If all other parameters remain constant, the flux density is inversely proportional to the frequency. Thus, for the third harmonic, the flux density will be one-third of the density at the fundamental frequency.

The full-width gap in the customary inductor linearizes the inductance at high-flux densities, since it prevents saturation of the magnetic core. But this gap introduces leakage inductance (loss), which increases exponentially with the gap-space. Leakage inductance introduces losses that increase with increasing frequency. Thus, the full-width gap enhances rejection of harmonics so that the combination of a fully-gapped inductor with a capacitor forms a tank that will ring, or oscillate, at one frequency only; and this rejection of harmonics aids in producing an almost perfect sine wave. However, by using only the partial gap of this invention, there is a remaining portion in the magnetic path tat has no gap. If properly proportioned, this remaining path permits and enhances the flux for the third harmonic wave, since it essentially eliminates the leakage inductance at that frequency. The total flux density (besides other constants in a given circuit) is a function of the net rms voltage, and it follows that if there is an increase of third harmonic flux, there must be an equal decrease of fundamental flx. Thus, there is an algebraic addition of the fundamental and third harmonic waves that results in harmonious ringing of the two waves. With properly chosen values for the remaining components in the circuit, the total flux density in the magnetic path can be controlled to achieve the power waveform of this invention. Since the ringing is initiated and maintained by the incoming AC-power, the third harmonic rings in phase with the fundamental, i.e., 0° of the third harmnnic is also 0° of the fundamental wave. Also, 180° of the fundamental coincides with a 180° point of the third harmonic.

So it can be stated that the harmonic inductor combines simultaneously several functions. The gapped portion of the center leg controls the waveform and amplitude of the fundamental sinewave. The no-gap portion, being one third of the total cross-sectional area of the center leg, enhances magnetic flux at the third harmonic of the fundamental wave. Since there is a tuning capacitor in parallel with the inductor, it forms a tank which rings at the third harmonic because it si excited by the fundamental sinewave it has a fixed, in-phase relationship to the fundamental wave. Since both waves, the fundamental and the third harmonic, exist simultaneously in the inductor, the resultant waveform constitutes the algebraic sum of both waves. Since the shape of the no-gap portion of the magnetic center gap is essentially uniform, and has a large ratio of width to height, there is no non-linear magnetic path which can emphazise higher order harmonics. Thus, only one, the third harmonic is generated in the circuit.

It was illustrated earlier that the ideal output wave has a 13.8% third harmonic content, and that ratio produces an essentially nominal output voltage for the same nominal input voltage. Thus, harmonic-enhancing inductor 321 permits simultaneous harmonious ringing at two frequencies. The suggested schematic symbol for this inductor is illustrated in block 321 of FIG. 3 with a break in the lines at 325.

Figure 6:
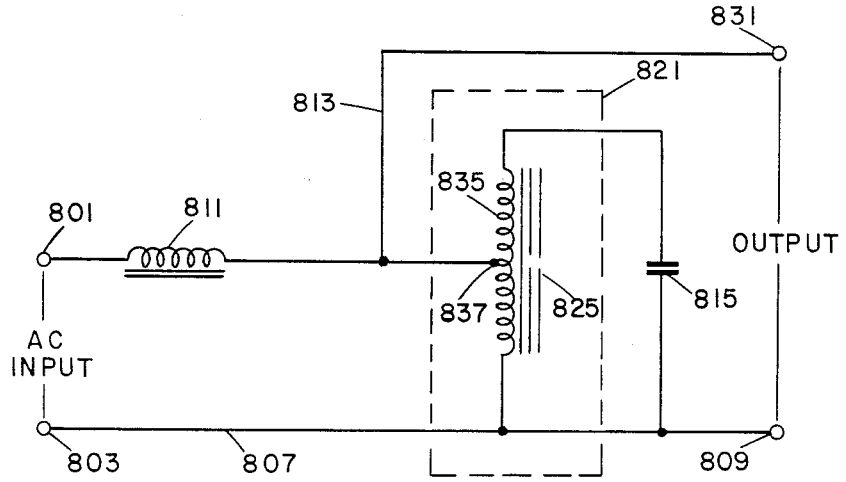
FIG. 6 is a schematic diagram of an alternate circuit arrangement of that illustrated in FIG. 1.

FIG. 6 illustrates a harmonic-enhancing inductor of this invention where the coil winding is used simultaneously to form an autotransformer 825 consisting of sections 835 and 837. Using the conventional impedance-matching formulas of a transformer, the value of the capacitor 815 as compared to capacitor 315 of FIG. 3 is reduced by the square-of-the-turns ratio of the total number of turns to winding 837. In this embodiment, the AC inputs 801 and 803, choke 811, output line 813, neutral line 807, outputs 831 and 809, and the inductor 821, all operate in the manner previously described relative to FIG. 1.

Figure 7:
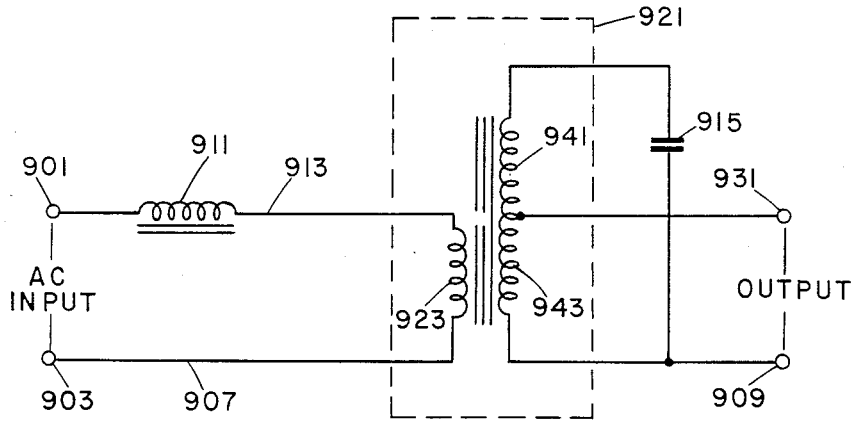
FIG. 7 is a schematic diagram of an alternate circuit to that illustrated in FIGS. 1 and 6.

FIG. 7 illustrates a harmonic-enhancing inductor 921 being used in combination with the circuit where separate input and output windings 923, 941, and 943 provide isolation between input and output circuits. The harmonic-enhancing inductor 921 in combination with the essential components described above provides a waveform generator that produces an energy conserving waveform that is ideal for operation of electronic equipment. Besides the uniqueness in combination of the waveform, the harmonic-enhancing inductor has the inherent capability to reject different frequencies such as input distortion and high-frequency radio interference, noise, and spikes. This is a well-known characteristic of tank circuits and enhances the usefulness for protection of critical equipment. In this embodiment, the AC inputs 901 and 903, choke 911, lines 913 and 907, capacitor 915, and outputs 931 and 909, all operate in the manner previously described relative to FIG. 1.

Since the harmonic inductor 921 in conjunction with the capacitor constitutes a ringing circuit in all of FIGS. 1, 6, and 7, it has energy stored that circulates back and forth between the capacitor and the harmonic inductor. Consequently, it holds a reserve energy that can maintain output power when there is a momentary interruption or loss of input power. This is a known characteristic of tank circuits, generally called "carry-through-energy," and is another desirable feature of a protective device for critical electronic equipment.

The harmonic inductor tank circuit has an inherent capability of self-regulating the output voltage. This characteristic is determined by the input reactor, for example choke 311 of FIG. 1, in conjunction with the partial magnetic gap, for example 411 of FIG. 2. As is well-known in the art, the flux-induced inductance (and consequent output voltage) becomes nonlinear at high-flux densities; only the gap prevents the ultimate saturation. Therefore, the voltage across the coil reaches a very nonlinear limit that prevents excessive output voltages when the input power increases to its high-voltage limits. The reactor 311 absorbs this excess input voltage (energy) in the form of a magnetic field of its own; and this field represents stored excess energy that is afterwards returned into the input power source with a power factor of near zero because it is a reactive current. Thus, the output voltage remains at a self-regulated level. Even though there is a small area in the magnetic path that has no gap, the core does not saturate under high-input line conditions. Since this self-regulation occurs without any saturation in the magnetic core, it occurs at extremely high efficiency. The excess power has some effect on the harmonic inductor, in that it causes a slight emphasis on the third harmonic, which produces a very slight, but insignificant, saddle at the 90° and 270° points of the fundamental wave. This will cause a small change in the rms output voltage, but the actual peak value remains well regulated. Again, this is the most important parameter for electronic equipment.

FIGS. 2–5 show the location of the (partial) gap at exactly the geometric centerline of the magnetic lamination. This provides interleaved stacking of identically shaped lamination pairs from opposite ends of the coil with a perfect mechanical match of the gaps. The advantage of this assembly technique is that the harmonic inductor will have a magnetic core that is mechanically so tightly interleaved that it cannot cause any audible humming noise, even during operation at increased flux densities. The audible noise is a common problem of all inductors that are constructed in accordance with prior art.

Figure 11:
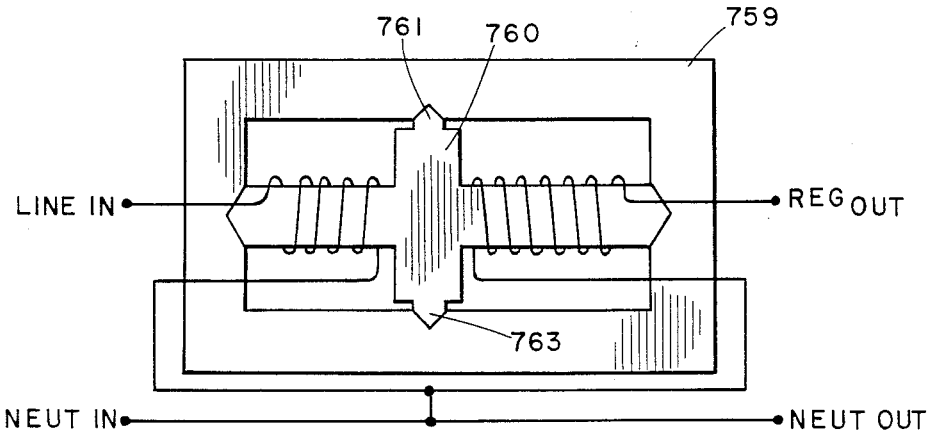
FIG. 11 is an illustration of another magnetic lamination to be used in the inductor.

It should also be understood that it is possible to combine the inductor 311 with the harmonic inductors 321, 821, or 921 on a common specially shaped lamination in a somewhat similar manner as it is used in the familiar cruciform lamination of ferro-resonant regulators (See FIG. 11). The lamination 759 and 760 has abutting portions 761 and 763 that form an approximate two-thirds partial gap to provide the third harmonic in the tank circuit.

Having fully described my invention, I claim:

1. An energy converter for converting AC-power to an output having a desired power waveform comprising, circuit means for receiving an AC-power waveform, said circuit means having output means for solely enhancing the fundamental and third harmonic of the AC-power waveform into a composit power output waveform, and reactor means for current limiting the AC power waveform to said output means and for providing buffer impedance to said output means.

2. An energy converter as claimed in claim 1 wherein, said output means having an inductor coil, said core having partial gap means for controlling all magnetic lines of flux generated by the core, and said gap means being located at the geometric center of the coil.

3. An energy converter as claimed in claim 2, wherein said core has three legs and said partial gap means is positioned in the center leg of the core with the gapped portion of the center leg controlling the waveform and amplitude of the fundamental sinewave and the non-gap portion in the center leg being about one-third of the total cross-sectional area of the center leg and enhancing the magnetic flux at the third harmonic of the fundamental wave; and said output means having tank circuit means for simultaneously providing the fundamental and third harmonic of the input AC waveform into the output AC waveform.

4. An energy converter as claimed in claim 1 wherein, said output means having an inductor coil with core laminations and windings, and said laminations having three legs with the center leg having a cross-sectional area and a partial gap that establishes a two-thirds ratio between the gap and the cross-sectional area of the center leg to provide the desired waveform output.

5. An energy converter as claimed in claim 4, wherein said partial gap is on the exact geometric center line of the laminations, said geometric center line being a line that extends perpendicular to the central longitudinal axis of the coil and parallel to the laminations.

6. An energy converter as claimed in claim 1, wherein said output means has an inductor coil with mating and abutting magnetic laminations having three legs, the laminations having a partial gap comprising one or more symmetrical openings on the geometric center line of the center leg;

said geometric center line being a line that extends perpendicular to the central longitudinal axis of the coil and parallel to the laminations; and the partial gap having a width comprising about two-thirds of the width of the center leg along said geometric center line.

7. An energy converter as claimed in claim 6 wherein, said partial gap comprising a rectangular opening centered from each side edge of the center leg.

8. An energy converter as claimed in claim 6 wherein, said partial gap comprises rectangular slots in the sides of the center leg with about one-third of the width of the center leg being between adjacent respective ends of said slots.

9. An energy converter as claimed in claim 6 wherein, said partial gap comprising plurality of openings in equidistant spacing in said center leg; and said openings being rectangular.

10. An energy converter as claimed in claim 6 wherein, said partial gap comprising a plurality of openings in equidistant spacing in said center leg, and said openings having curved edges.

11. An energy converter as claimed in claim 1, wherein said output measns has an inductor coil with core laminations and windings, said laminations comprising "E" and "I" shaped mating parts.

12. An energy converter as claimed in claim 6 wherein, said partial gap comprises slots in each side of the center leg at each end of the center leg.

13. An energy converter as claimed in claim 1 wherein, said output means having an inductor coil with core laminations and windings, first ones of said laminations having a centered gap, and second ones of said laminations without a gap.

* * * * *

UNITED STATES PATENT AND TRADEMARK OFFICE

CERTIFICATE OF CORRECTION

PATENT NO. : 4,795,959

DATED : January 3, 1989

INVENTOR(S) : Edward Cooper

It is certified that error appears in the above-identified patent and that said Letters Patent is hereby corrected as shown below:

Claim 2, column 9, line 28, after "coil" insert --with a core --

Claim 2, column 9, line 30, replace "core" with --coil--;

Claim 2, column 9, line 32, replace "coil" with --core--.

Signed and Sealed this

Tenth Day of October, 1989

*Attest:*

*Attesting Officer*

DONALD J. QUIGG

*Commissioner of Patents and Trademarks*